US007021324B1

(12) United States Patent
Clay et al.

(10) Patent No.: US 7,021,324 B1
(45) Date of Patent: Apr. 4, 2006

(54) WALKER WITH CANE HOLDER AND NON-CATCH CASTORS

(76) Inventors: Charles L. Clay, 571 W. Miracle Strip Pkwy., Mary Esther, FL (US) 32569; Daniel Kyler, 116 Third Ave., Fort Walton Beach, FL (US) 32548

( * ) Notice: Subject to any disclaimer, the term of this patent is extended or adjusted under 35 U.S.C. 154(b) by 0 days.

(21) Appl. No.: 10/653,657

(22) Filed: Sep. 3, 2003

(51) Int. Cl.
*A61H 3/00* (2006.01)

(52) U.S. Cl. ..... 135/67; 135/66

(58) Field of Classification Search ..... 135/88.04, 135/120.3, 16, 17, 65, 66, 67, 19, 912; 280/87.01, 280/87.051; 248/229.17, 229.16, 314, 316.7, 248/220.21, 220.22; 24/462, 3.12, 459; 297/5
See application file for complete search history.

(56) References Cited

U.S. PATENT DOCUMENTS

| | | | | | |
|---|---|---|---|---|---|
| 191,782 | A | * | 6/1877 | Smith | 224/190 |
| 1,394,224 | A | | 10/1921 | Scott | |
| 2,077,564 | A | | 4/1937 | Kish | |
| 2,613,389 | A | | 10/1952 | Crumer | |
| 2,745,465 | A | | 5/1956 | Hogan | |
| 2,981,312 | A | | 4/1961 | Sundbery | |
| 4,094,330 | A | | 6/1978 | Jong | |
| 4,251,105 | A | | 2/1981 | Barker | |
| 4,407,472 | A | * | 10/1983 | Beck | 248/89 |
| D271,254 | S | | 11/1983 | Morris | |
| 4,748,994 | A | * | 6/1988 | Schultz et al. | 135/67 |
| 4,800,910 | A | | 1/1989 | Gamm | |
| 4,822,316 | A | * | 4/1989 | Shaffer et al. | 446/466 |
| 5,133,377 | A | | 7/1992 | Truxillo | |
| D330,878 | S | | 11/1992 | Donaldson | |
| 5,697,129 | A | * | 12/1997 | Newville | 24/339 |
| 5,794,639 | A | | 8/1998 | Einbinder | |
| 6,131,925 | A | * | 10/2000 | Weldon | 280/30 |
| 6,186,461 | B1 | * | 2/2001 | Pelaez | 248/314 |
| 6,330,989 | B1 | * | 12/2001 | Okamoto | 248/74.1 |
| 6,371,142 | B1 | * | 4/2002 | Battiston | 135/67 |
| 6,601,865 | B1 | * | 8/2003 | Harper | 280/304.1 |
| 6,672,321 | B1 | * | 1/2004 | Hamilton | 135/67 |

* cited by examiner

*Primary Examiner*—Janet M. Wilkens
(74) *Attorney, Agent, or Firm*—Peter Loffler

(57) ABSTRACT

A walker has a first generally U-shaped frame member with a front and rear leg and a second generally U-shaped frame member with a front and rear leg. Castors are rotatably attached to each front leg such that the castors face each other and each are attached by passing a bolt through the castor and receiving the bolt within a screw boss within the respective leg. A lower bracket with a base and an annular flange and an upper bracket with a resilient C-clip, axially aligned with the lower bracket, are each attached to one of the legs and allow a cane to be removably secured within the two brackets.

4 Claims, 2 Drawing Sheets

WALKER WITH CANE HOLDER AND NON-CATCH CASTORS

BACKGROUND OF THE INVENTION

1. Field of the Invention

The present invention relates to a four legged walker that has a cane holder for easy retrieval by the user as well as castors that do not catch on objects that the castors pass such objects whenever a user is walking with the walker.

2. Background of the Prior Art

Walkers are used by persons who, either due to injury or age, lack full ambulatory ability without some form of assistance, yet who do not require the more restrictive confines of a wheelchair or wheel scooter. Typically, a walker consists of a pair of generally upright U-shaped frames members that are joined together by one or more crossbars that connect the front legs of each frame member to form a generally U-shaped structure when viewed from above. A user stands within the U-shaped structure and grasps the tops of each frame member and uses the walker to aid in walking, typically taking a step by resting a portion of the user's weight on the walker, advancing the walker some distance, and thereafter taking another step, and repeating this process. The walker givers the user a greater sense of mobility than can be achieved by walking independently (which some users simply cannot accomplish) or by the use of a cane alone, which although giving some support to a user, fails to give the substantial support of a walker than envelopes a user on three sides when the walker is being used and allows the user to rest a substantial portion of the user's body weight onto the walker during use.

Some walkers come equipped with castors, either on the front legs of each frame member or on all legs of the walker. The castors allow a user to roll the walker ahead between steps instead of having to lift and advance the walker between steps. Many users find the castor-based walkers to be a substantial improvement over non-castor-based walkers. One problem associated with such castor-based walkers is that the castors, which are positioned on the outside of the front legs, tend to catch on various items, such as walls, corners, doors, etc., as the walker, being handled by the user, passes such items. This catching of the castors onto such items not only causes instability to the user, which can cause a user to fall, but such catching also scuffs or dings the various surfaces impacted by the castors.

In order to combat this problem, walkers have been proposed wherein the castors are positioned on the inside of each front leg (the castors facing each other as opposing to facing away from each other when the castors are on the outside of each leg) so as to prevent the castor from unwantingly bumping surfaces. In such a design, the castor is positioned on the inside of a leg and an appropriate axial bolt is passed through the castor and through the front leg and is capped by an appropriate nut on the other side. However, this nut, and any excess bolt length that extends beyond the nut can also catch and snag on various items, oftentimes causing more instability to the user as well as more damage than if the castor were located on the outside of the leg of the walker.

An additional shortcoming found in modern day walkers concerns the use by such walkers by people who are generally ambulatory, but use the walker for added aid and support for routine walking. Such walker users comprise a large percentage of walker users. Typically, such users can get by with the use of a simple cane for many walking tasks. Such people use the walker for major travel, for example, walking about a shopping mall, but desire to switch to a less restrictive cane when going to a particular store within the mall, as the cane gives them more maneuverability within the store. The problem with this arrangement is that in using the walker for general ambulatory progression, both of the user's hands are dedicated to maneuvering the walker. The user lacks the ability to effectively grip a cane while maintaining appropriate control of the walker. Such a user is forced to improvise such as by strapping the cane to the user's back or carrying the cane underarm. While such improvisations may achieve the desired goal of carrying a cane while using a walker, such improvisations tend to be awkward for the user to implement, not only in donning the cane for transport, but also in retrieving the cane whenever the user wants to switch from walker to cane, they tend to be somewhat uncomfortable, and they leave many users self-conscious when carrying the cane while at the same time using the walker for ambulatory assistance.

Therefore, there exists a need in the art for a ambulatory walker that overcomes the about-stated shortcomings in the art. Specifically, such a walker must provide the user with a leg-based castors which castors and their attendant attachment systems tend not to catch or otherwise snag on surfaces with which castors come into close proximity so that the user is not destabilized while using the walker and so that such surfaces are not damaged by the use of the walker. Additionally, such a walker must allow for efficient transport of a cane for use by the user in order to allow the user to quickly switch from use of the walker to the cane and back again wherein the transport of the cane is relatively simple and straightforward so that the user can quickly don as well as retrieve the cane without undue hassle. Such transport of the cane must not be uncomfortable to the user and should not make the user self-conscious about carrying a cane while using the walker.

SUMMARY OF THE INVENTION

The walker with cane holder and non-catch castors of the present invention addresses the aforementioned needs in the art. The walker with cane holder and non-catch castors provides a user with a leg-based castors which castors and their attendant attachment systems tend not to catch or otherwise snag on surfaces with which castors come into close proximity during use of the walker by the user so that the user is not destabilized while using the walker and so that such surfaces are not damaged by the use of the walker. The walker allows for efficient transport of a cane for use by the user and allows the user to quickly switch from use of the walker to the cane and back again wherein the transport of the cane is relatively simple and straightforward so that the user can quickly don as well as retrieve the cane without undue hassle. The transport of the cane is not be uncomfortable to the user and typically does not make the user self-conscious about carrying a cane while using the walker.

The walker with cane holder and non-catch castors of the present invention is comprised of a first generally U-shaped frame member having a first front leg and a first rear leg and a second generally U-shaped frame member having a second front leg and a second rear leg, the first front leg and the second front leg being joined by an appropriate cross member. A first castor is rotatably attached on the first front leg such that the first castor faces the second front leg while a second castor is rotatably attached on the second front leg such that the second castor faces the first front leg. The first castor is attached to the first front leg by passing a first axial bolt through the first castor and into the first front leg wherein the first axial bolt is received within a first screw boss and the second castor is attached to the second front leg by passing a second axial bolt through the second castor and into the second front leg wherein the second axial bolt is received within a second screw boss. A lower bracket is attached to the first front leg, the lower bracket having a base and an annular flange, while an upper bracket is attached to the first front leg above the lower bracket, the upper bracket being a resilient C-clip that is longitudinally aligned with the annular flange. A cane is removably received within the upper bracket and rests on the base of the lower bracket.

BRIEF DESCRIPTION OF THE DRAWINGS

Similar reference numerals refer to similar parts throughout the several views of the drawings.

DESCRIPTION OF THE PREFERRED EMBODIMENT

Figure 1:
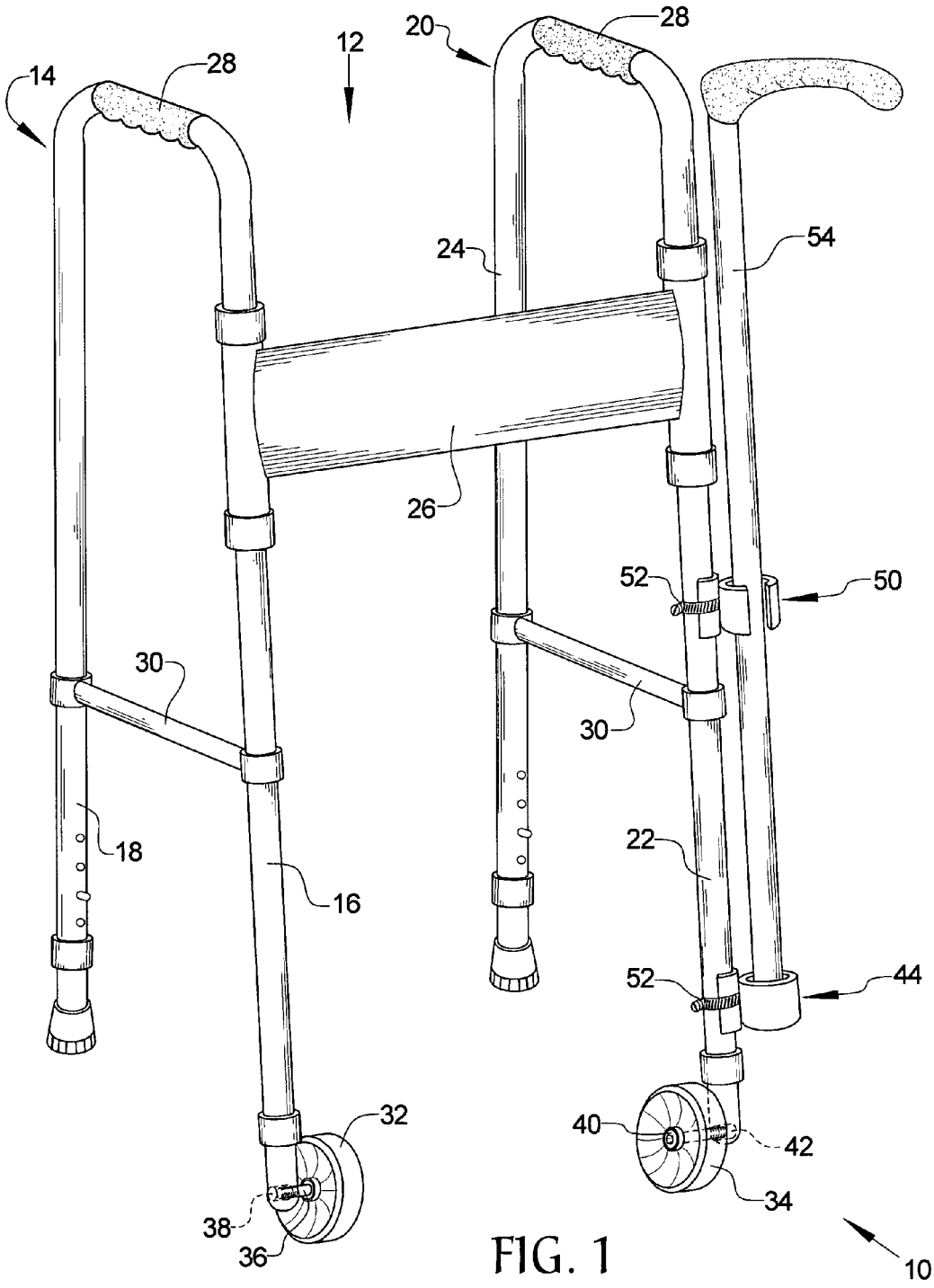
FIG. 1 is a perspective view of the walker with cane holder and non-catch castors of the present invention holding a cane.
Figure 2:
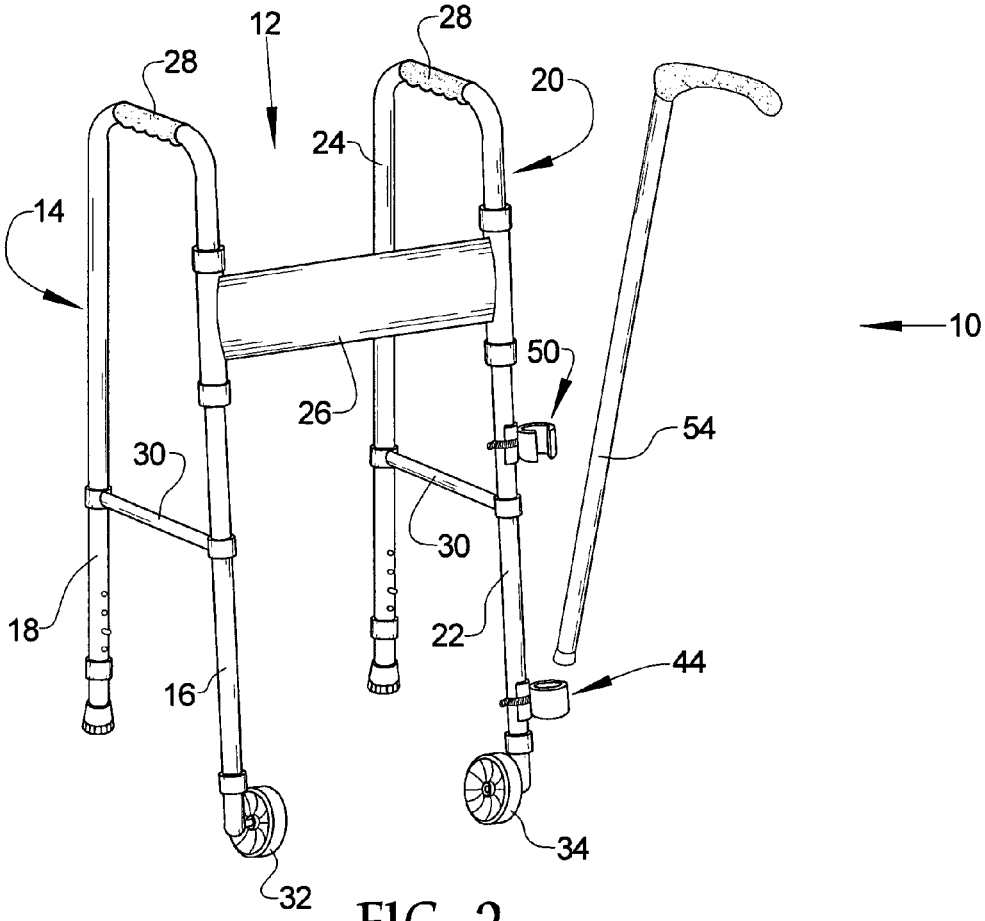
FIG. 2 is a perspective view of the walker with cane holder and non-catch castors of the present invention with the cane removed from the walker.
Figure 3:
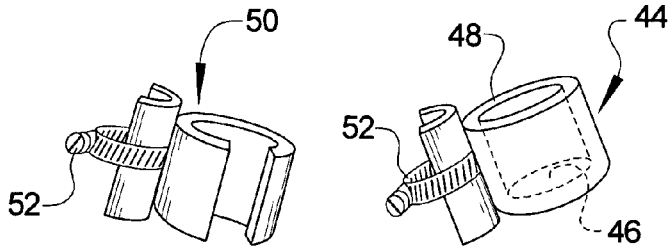
FIG. 3 is a perspective view of the upper and holder cane holding brackets.

Referring now to the drawings, it is seen that the walker with cane holder and non-catch castors of the present invention, generally denoted by reference numeral 10, is comprised of any standard walker 12 that has a first generally U-shaped frame member 14 with a first front leg 16 and a first rear leg 18 and a second generally U-shaped frame member 20 with a second front leg 22 and a second rear leg 24. The first front leg 16 is joined with the second front leg 22 by an appropriate cross member 26 of any design known in the art (the illustrated cross member 26 that allows folding of the walker 12, a scissors-based cross member, etc.).

As see, the walker 10 can have various standard features found on typical walkers such as padded grips 28, telescoping legs, braces 30 between front and rear legs, etc.

A first castor 32 of any appropriate type known in the art is rotatably attached on the first front leg 16 such that the first castor 32 is mounted so that it faces the second front leg 22 while a similar second castor 34 is rotatably attached on the second front leg 22 such that the second castor 34 is mounted so that it faces the first front leg 16. The first castor 32 is attached to the first front leg 16 by passing a first axial bolt 36 through the first castor 32 and into the first front leg 16 wherein the first axial bolt 36 is received within a first screw boss 38 and the second castor 34 is attached to the second front leg 22 by passing a second axial bolt 40 through the second castor 34 and into the second front leg 22 wherein the second axial bolt 40 is received within a second screw boss 42. This attachment method of castors to legs allows the castors 32 and 34 to rotate while maintaining the smoothness of the outer surface of each front leg (or rear leg if castors are also attached to these legs) so that when a user is using the walker 10 for ambulatory progression, neither the castors 32 and 34, nor the respective attachment hardware 36 and 40 tend to catch or snag on various surfaces that come in close proximity to the walker 10.

A lower bracket 44 is attached to the first front leg 16 (or any other leg), the lower bracket 44 having a base 46 and an annular flange 48. An upper bracket 50 is attached to the first front leg 16 above the lower bracket 44, the upper bracket 50 being a resilient C-clip that is longitudinally aligned with the annular flange 48 of the lower bracket 44. The two brackets 44 and 50 can be attached to the appropriate leg in any desired fashion such as by the use of the illustrated ring clamps 52. A cane 54 is removably received within the upper bracket 50 and rests on the base 46 of the lower bracket 44. The cane 54 snap-clips into the upper bracket 50 and is held thereat, while the annular flange 48 of the lower bracket 44 helps prevent the cane 54 from becoming dislodged off of the base 46 of the lower bracket 44. If the user desires to retrieve the cane 54, the user simply grasps the cane 54 and unclips the cane 54 from the grip of the upper bracket 50.

Accordingly, the walker with cane holder and non-catch castors 10 of the present invention allows a user to have a castor-based walker wherein the castors 32 and 34 and their attendant attachment hardware 36 and 40 tend not to catch or otherwise snag on surfaces with which the walker 10 comes into close proximity, such as walls, table legs, etc. Additionally, the walker 10 allows a user to carry a cane 54, via the walker 10, wherein the cane 54 is easy to store upon and retrieve from the walker 10, as needed.

While the invention has been particularly shown and described with reference to an embodiment thereof, it will be appreciated by those skilled in the art that various changes in form and detail may be made without departing from the spirit and scope of the invention.

We claim:

1. A walker comprising:

a first generally U-shaped frame member having a first front leg and a first rear leg;

a second generally U-shaped frame member having a second front leg and a second rear leg;

a cross member joining the first front leg with the second front leg;

a first castor rotatably attached on the first front leg such that the first castor faces the second front leg;

a second castor rotatably attached on the second front leg such that the second castor faces the first front leg;

a lower bracket removably attached to the first front leg, the lower bracket having a base and an annular flange;

an upper bracket removably attached to the first front leg above the lower bracket, the upper bracket being a resilient C-clip such that the C-clip is longitudinally aligned with the annular flange;

wherein a cane is adapted to be removably received within the upper bracket and to rest on the base of the lower bracket;

a first ring clamp attached to lower bracket and encompassing the first front leg for facilitating the removable attachment of the lower bracket to the first front leg; and a second ring clamp attached to upper bracket and encompassing the first front leg for facilitating the removable attachment of the upper bracket to the first front leg.

2. The walker as in claim 1 wherein the first castor is attached to the first front leg by passing a first axial bolt through the first castor and into the first front leg wherein the first axial bolt is received within a first screw boss and wherein the second castor is attached to the second front leg by passing a second axial bolt through the second castor and into the second front leg wherein the second axial bolt is received within a second screw boss.

3. A walker comprising:

a first generally U-shaped frame member having a first front leg and a first rear leg;

a second generally U-shaped frame member having a second front leg and a second rear leg;

a cross member joining the first front leg with the second front leg;

a lower bracket removably attached to the first front leg, the lower bracket having a base and an annular flange;

an upper bracket removably attached to the first front leg above the lower bracket, the upper bracket being a resilient C-clip such that the C-clip is longitudinally aligned with the annular flange;

wherein a cane is adapted to be removably received within the upper bracket and to rest on the base of the lower bracket;

a first ring clamp attached to lower bracket and encompassing the first front leg for facilitating the removable attachment of the lower bracket to the first front leg; and a second ring clamp attached to upper bracket and encompassing the first front leg for facilitating the removable attachment of the upper bracket to the first front leg.

4. The walker as in claim 3 further comprising:

a first castor rotatably attached to the first front leg; and a second castor rotatably attached to the second front leg.

* * * * *